US009663323B2

(12) United States Patent
Stolt et al.

(10) Patent No.: US 9,663,323 B2
(45) Date of Patent: May 30, 2017

(54) METHOD AND AN ELEVATOR FOR STOPPING AN ELEVATOR CAR USING ELEVATOR DRIVE

(71) Applicants: Lauri Stolt, Helsinki (FI); Ari Kattainen, Hyvinkaa (FI)

(72) Inventors: Lauri Stolt, Helsinki (FI); Ari Kattainen, Hyvinkaa (FI)

(73) Assignee: KONE Corporation, Helsinki (FI)

( * ) Notice: Subject to any disclaimer, the term of this patent is extended or adjusted under 35 U.S.C. 154(b) by 477 days.

(21) Appl. No.: 14/448,290

(22) Filed: Jul. 31, 2014

(65) Prior Publication Data

US 2015/0075915 A1 Mar. 19, 2015

(30) Foreign Application Priority Data

Sep. 17, 2013 (EP) ..... 13184657

(51) Int. Cl.
*B66B 1/32* (2006.01)
*B66B 1/30* (2006.01)

(52) U.S. Cl.
CPC ..... *B66B 1/30* (2013.01)

(58) Field of Classification Search
CPC ..... B66B 1/30
USPC ..... 187/247, 248, 288, 293, 296, 297, 391, 187/393
See application file for complete search history.

(56) References Cited

U.S. PATENT DOCUMENTS 4,785,914 A * 11/1988 Blain ..... B66B 1/24 187/280
5,159,162 A * 10/1992 Tatino ..... B66B 1/44 187/280
6,173,814 B1 * 1/2001 Herkel ..... B66B 1/34 187/248
7,775,330 B2 * 8/2010 Kattainen ..... B66B 5/04 187/287
8,118,140 B2 * 2/2012 Kattainen ..... B66B 1/34 187/284
8,365,873 B2 * 2/2013 Viita-Aho ..... B66B 5/0031 187/314
8,584,812 B2 * 11/2013 Dorsch ..... B66B 5/0031 187/287

(Continued)

OTHER PUBLICATIONS

European Search Report for EPSN 13184657.8 dated Feb. 28, 2014.

*Primary Examiner* — Anthony Salata
(74) *Attorney, Agent, or Firm* — Harness, Dickey & Pierce, P.L.C.

(57) ABSTRACT

The invention relates to a method and an apparatus. In the method there is determined a speed limit or an acceleration limit for an elevator car based on elevator state information, the elevator state information comprising at least information on whether the elevator car is being driven or whether the elevator car is in a floor. Power supply to the motor is disabled and brakes are applying for braking movement of the elevator car. Speed or acceleration of the elevator car is measured, in response to the applying of the at least one brake and the disabling of the power supply to the motor. It is determined whether the at least one of speed and acceleration of the elevator car exceeds the respective at least one of the speed limit and the acceleration limit. Thereupon, power supply to the motor is enabled for stabilizing movement of the elevator car.

17 Claims, 6 Drawing Sheets

(56) References Cited

U.S. PATENT DOCUMENTS

| | | | | |
|---|---|---|---|---|
| 8,820,482 | B2 * | 9/2014 | De Coi | B66B 5/0031 187/247 |
| 8,869,945 | B2 * | 10/2014 | Harkonen | B66B 1/28 187/288 |
| 9,422,133 | B2 * | 8/2016 | Rebillard | B66B 1/32 |
| 2003/0168290 | A1 | 9/2003 | Miyakoshi et al. | |
| 2009/0288920 | A1 | 11/2009 | Kattainen et al. | |
| 2016/0145074 | A1 * | 5/2016 | Kattainen | B66B 5/022 187/254 |
| 2016/0167921 | A1 * | 6/2016 | Kattainen | B66B 1/24 187/247 |

* cited by examiner

METHOD AND AN ELEVATOR FOR STOPPING AN ELEVATOR CAR USING ELEVATOR DRIVE

This application claims priority to European Patent Application No. EP13184657.8 filed on Sep. 17, 2013, the entire contents of which are incorporated herein by reference.

BACKGROUND OF THE INVENTION

Field of the Invention

The invention relates to elevators, elevator safety arrangements, and a method and an elevator for stopping an elevator car using elevator drive.

Description of the Related Art

Elevator brakes are an extremely important safety feature. Despite the use of a counterbalance, free falling of a traction elevator car either upwards or downwards may have detrimental effects. The counterbalance is sized to have a mass of an elevator car with 50% load. With such a choice of counterbalance, an empty elevator car or an elevator car with only a single passenger or a few passengers is more likely to accelerate uncontrollably upwards in case no brakes are applied. The movement of an elevator car may be slowed down by a worm gear, if the elevator motor uses gears. However, with the introduction of gearless elevator motors, the acceleration becomes higher. Elevator shafts may be equipped with buffers which comprise, for example, springs. The problem with buffers is that in elevators with limited upper or lower space it is not possible to install buffers that would provide safe deceleration. This is usually due to the fact that elevators may be installed in old buildings where it is not possible to reserve an entire top or bottom floor for buffers only. Further, it may be difficult to change a building afterwards so that structures sufficient to mount heavy impact buffers could be built. In many cases buffers are capable of absorbing speed up to 60% of the maximum speed.

Due to these factors elevator brakes are designed with pronounced fault-tolerance. Brakes associated with a traction sheave are usually duplicated. The design of the brakes is such that sudden loss of electrical power does not result into a failure of the brakes. When power supply to elevator brakes interrupts, the elevator brakes close mechanically. This involves that elevator brake disks or pads grip the traction wheel. In addition to traction wheel brakes, an elevator car may be equipped with grippers that grip elevator car tracks in the elevator shaft in order to brake the elevator car. The general purpose of the tracks is to keep the elevator car steady and inhibit swinging of the elevator car when being hoisted with the traction wheel. Elevators are also equipped in an overspeed governor, which consists of an overspeed governor wheel, governor ropes connected to the elevator car and the counterbalance, and a sheave. In the event of a significant overspeed centrifugal force causes the overspeed governor wheel to pull a braking wire which in turn causes wedge-shaped brakes to engage the elevator car tracks. The problem with braking the elevator car using grippers or the overspeed governor is that the deceleration may become rapid. The resulting torque may feel unpleasant. Further, gripping procedure is irretrievable such that when the gripping has taken place, a serviceman has to visit the elevator site to restore the elevator operation and release the passengers from the elevator car. Usually, elevator car grippers are applied in extreme overspeed or fault situations.

Despite the fact that traction sheave brakes are duplicated, fault situations may occur where both brakes fail simultaneously. A possible such situation may occur, if the brakes have been disabled manually during maintenance or inspection.

In prior art elevator safety circuits have only made it possible to cut power supply to an elevator. This has resulted in a situation where only mechanical safety measures are available for braking the elevator car. However, with the introduction of processor controlled elevator safety systems, it has become possible to apply more sophisticated safety measures.

Due to the aforementioned problems, it would be beneficial to be able to stop an elevator car more gracefully. Further, it would be beneficial to be able to introduce a further measure of safety for the stopping of an elevator car at the event of a failure.

SUMMARY OF THE INVENTION

According to an aspect of the invention, the invention is a method, comprising: determining, by a safety controller, at least one of a speed limit and an acceleration limit for an elevator car based on elevator state information, the elevator state information comprising at least one of the elevator car is being driven, the elevator car is within a predefined distance from a destination floor, the elevator car is in a floor, and an attempt to apply at least one brake has been made; detecting a need to perform braking of the elevator car, the need being due to at least one of the elevator car being within a predefined distance from a destination floor, an exceeding of the speed limit and an exceeding of the acceleration limit; disabling power supply to the motor, in response to the detecting of the need to perform braking; attempting to apply the at least one brake for braking movement of the elevator car, in response to the detecting of the need to perform braking; measuring at least one of speed and acceleration of the elevator car using at least one first sensor, in response to the attempt to apply the at least one brake and the disabling of the power supply to the motor; determining whether the at least one of speed and acceleration of the elevator car exceeds the respective at least one of the speed limit and the acceleration limit; and enabling, by the safety controller, power supply to the motor for stabilizing movement of the elevator car, in response to the exceeding of the respective at least one of the speed limit and the acceleration limit.

According to a further aspect of the invention, the invention is an apparatus comprising at least one processor and at least one memory including computer program code, the at least one memory and the computer program code configured to, with the at least one processor, cause the apparatus at least to perform: determining at least one of a speed limit and an acceleration limit for an elevator car based on elevator state information, the elevator state information comprising at least one of the elevator car is being driven, the elevator car is within a predefined distance from a destination floor, the elevator car is in a floor, and an attempt to apply at least one brake has been made; detecting a need to perform braking of the elevator car, the need being due to at least one of the elevator car being within a predefined distance from a destination floor, an exceeding of the speed limit and an exceeding of the acceleration limit; disabling power supply to the motor, in response to the detecting of the need to perform braking; attempting to apply the at least one brake for braking movement of the elevator car, in response to the detecting of the need to perform braking; measuring at least one of speed and acceleration of the elevator car using at least one first sensor, in response to the attempt to apply the at least one brake and the disabling of the power supply to the motor; determining whether the at least one of speed and acceleration of the elevator car exceeds the respective at least one of the speed limit and the acceleration limit; and enabling power supply to the motor for stabilizing movement of the elevator car, in response to the exceeding of the respective at least one of the speed limit and the acceleration limit.

According to a further aspect of the invention, the invention is an elevator safety controller comprising the apparatus.

According to a further aspect of the invention, the invention is a safety apparatus for an elevator, the safety apparatus comprising: a safety controller further comprising a first message bus, at least one sensor interface connected to the first message bus and at least one sensor in the elevator, at least one processor connected to the first message bus, the at least one processor being configured to determine at least one of a speed limit and an acceleration limit for an elevator car based on elevator state information, the elevator state information comprising at least one of the elevator car is being driven, the elevator car being within a predefined distance from a destination floor, the elevator car being in a floor, and an attempt to apply at least one brake being made, to detect a need to perform braking of the elevator car, the need being due to at least one of the elevator car being within a predefined distance from a destination floor, an exceeding of the speed limit and an exceeding of the acceleration limit, to disable power supply to the motor, in response to the detecting of the need to perform braking, to attempt to apply the at least one brake for braking movement of the elevator car, in response to the detecting of the need to perform braking, to measure at least one of speed and acceleration of the elevator car using at least one first sensor, in response to the attempt to apply the at least one brake and the disabling of the power supply to the motor, to determine whether the at least one of speed and acceleration of the elevator car exceeds the respective at least one of the speed limit and the acceleration limit, and to enable power supply to the motor for stabilizing movement of the elevator car, in response to the exceeding of the respective at least one of the speed limit and the acceleration limit.

According to a further aspect of the invention, the invention is an apparatus comprising means for performing each of the method steps.

According to a further aspect of the invention, the invention is a computer program comprising code adapted to cause the following when executed on a data-processing system: determining at least one of a speed limit and an acceleration limit for an elevator car based on elevator state information, the elevator state information comprising at least one of the elevator car is being driven, the elevator car is within a predefined distance from a destination floor, the elevator car is in a floor, and an attempt to apply at least one brake has been made; detecting a need to perform braking of the elevator car, the need being due to at least one of the elevator car being within a predefined distance from a destination floor, an exceeding of the speed limit and an exceeding of the acceleration limit; disabling power supply to the motor, in response to the detecting of the need to perform braking; attempting to apply the at least one brake for braking movement of the elevafor car, in response to the detecting of the need to perform braking; measuring at least one of speed and acceleration of the elevator car using at least one first sensor, in response to the attempt to apply the at least one brake and the disabling of the power supply to the motor; determining whether the at least one of speed and acceleration of the elevator car exceeds the respective at least one of the speed limit and the acceleration limit; and enabling power supply to the motor for stabilizing movement of the elevator car, in response to the exceeding of the respective at least one of the speed limit and the acceleration limit.

According to a further aspect of the invention, the invention is a computer program product comprising the computer program.

In one embodiment of the invention, the elevator car may also be referred to as elevator cage. The elevator car may be elevator cage.

In one embodiment of the invention, the apparatus is a semiconductor circuit, a chip or a chipset.

In one embodiment of the invention, the method further comprises repeating the determining, by the safety controller, of the at least one of the speed limit and the acceleration limit for the elevator car based on elevator state information, the elevator state information comprising at least one of the elevator car is being driven, the elevator car is within a predefined distance from a destination floor, the elevator car is in a floor, and an attempt to apply the at least one brake has been made, in response to the attempt to apply the at least one brake and the disabling of the power supply to the motor.

In one embodiment of the invention, the determining, by the safety controller, of the at least one of the speed limit and the acceleration limit for the elevator car based on the elevator state information is repeated in response to any change in the elevator state information, for example, in response an attempt to apply the at least one brake. The attempt to apply the at least one brake being made may be considered to be comprised in the elevator state information.

In one embodiment of the invention, the power supply to the motor is disabled in response to approaching a floor and the at least one brake is applied in response to the approaching the floor.

In one embodiment of the invention, the method further comprises measuring at the least one of an initial speed and an initial acceleration of the elevator car; comparing, by the safety controller, the at least one of the initial speed and the initial acceleration of the elevator car to the respective at least one of the speed limit and the acceleration limit, to determine whether the at least one of the speed limit and the acceleration limit is exceeded.

In one embodiment of the invention, the power supply to the motor is disabled by the safety controller, in response to the exceeding of the at least one of the speed limit and the acceleration limit, and the at least one brake is applied, by the safety controller, by disabling power supply to the at least one brake.

In one embodiment of the invention, the method further comprises determining, by the safety controller, a state of at least one second sensor associated with the elevator, the at least one second sensor indicating whether the elevator car may be moved without danger; determining whether the elevator car or a counterweight of the elevator is heavier; regulating power supply to the motor in order to bring the elevator car to the bottom floor, if the elevator car is heavier than the counterweight, or the top floor, if the counterweight is heavier that the elevator car, in response to the at least one second sensor indicating that the elevator car may be moved without danger.

In one embodiment of the invention, the method further comprises determining, by the safety controller, a state of at least one second sensor associated with the elevator, the at least one second sensor indicating whether the elevator car may be moved without danger; and regulating power supply to the motor in order to keep the elevator car in a stable vertical position, by the safety controller, in response to the at least one second sensor indicating that the elevator car may not be moved without danger.

In one embodiment of the invention, the at least one second sensor comprises at least one door sensor indicating whether a door is closed.

In one embodiment of the invention, the power supply to the motor is regulated by a frequency converter, under supervision of the safety controller.

In one embodiment of the invention, the power supply to the motor is regulated by the safety controller. The regulation may be achieved by the safety controller so that the safety controller controls a converter to output a pulse-width modulated signal.

In one embodiment of the invention, the safety controller is configured to control a converter to output a pulse-width modulated signal having a duty cycle which causes a torque in the motor that is sufficient to stop the traction wheel and the elevator car.

In one embodiment of the invention, the at least one second sensor comprises at least one motion detector configured to determine a movement in elevator shaft. The motion detectors may be configured to determine motion in positions and time periods in the elevator shaft where the motion of the counterbalance and the elevator car and traction means does confuse the motion detectors.

In one embodiment of the invention, the method further comprises comparing a position of the elevator car to a target floor position, the target floor being the bottom floor or the top floor; and controlling, by the safety controller, power supply to the motor in order to bring the elevator car to the bottom floor or the top floor.

In one embodiment of the invention, the at least one brake of the elevator comprises at least two brakes configured to brake a traction wheel of the elevator.

In one embodiment of the invention, the at least one brake of the elevator comprises at least two brakes configured to grip at least two respective tracks of the elevator car.

In one embodiment of the invention, the at least one first sensor comprise at least one of an elevator car speedometer, an accelerometer, a traction sheave speedometer and an elevator car based air pressure speedometer.

In one embodiment of the invention, the safety controller is configured to control a converter via a control interface of the converter, the control interface being configured to receive a first separate power supply disable/enable signal for the at least one brake and a second power supply disable/enable for signals for the motor.

In one embodiment of the invention, the elevator state information further comprises information on at least one of whether the speed of the elevator car being increased due to a departure from a floor, whether the elevator is being driven using maximum normal speed, whether the speed of the elevator car is being reduced due to a pending arrival to a floor.

In one embodiment of the invention, the elevator state information further comprises information on whether the elevator car is in a floor with at least one of elevator car door open and floor door open, the floor door being to the floor the elevator car is in.

In one embodiment of the invention, the elevator comprises a drive controller, which may comprise at least one processor and a memory. The drive controller may be configured to control power supply to the elevator motor in order to serve elevator calls.

In one embodiment of the invention, the speed limit or the acceleration limit may be zero when the elevator car is in a floor.

In one embodiment of the invention, the speed limit or the acceleration limit may be zero when the elevator car is in a floor and at least one door leading to the elevator car is open.

In one embodiment of the invention, the safety controller determines the speed limit or the acceleration limit for the elevator car based on a target speed set by the drive controller, the target speed being determined based on at least one of whether the elevator car is accelerating from a floor, whether the elevator car is driven with maximum speed, whether the elevator car is decelerating to approach a floor where the elevator car is scheduled to stop, and whether the elevator car is stopped to a floor with at least one door open to the elevator car. If the target speed is above zero, the speed limit may be set a predefined value above the target speed. If the target speed is zero, for example due to the elevator car being in a floor, the speed limit or the acceleration limit may also be set to zero.

In one embodiment of the invention, the safety controller may be configured to receive from an elevator drive controller information on the elevator state information, the elevator drive controller being configured to serve elevator calls using the elevator car. The drive controller may comprise at least one processor and a memory. The drive controller may control an electrical converter to drive the elevator motor.

In one embodiment of the invention, the at least one brake is configured to keep in an open position while being supplied with electricity.

In one embodiment of the invention, the computer program is stored on a non-transitory computer readable medium. The computer readable medium may be, but is not limited to, a removable memory card, a removable memory module, a magnetic disk, an optical disk, a holographic memory or a magnetic tape. A removable memory module may be, for example, a USB memory stick, a PCMCIA card or a smart memory card.

In one embodiment of the invention, an apparatus comprising at least one processor and at least one memory including computer program code, the at least one memory and the computer program code are configured to, with the at least one processor, cause the apparatus at least to perform a method according to any of the method steps.

In one embodiment of the invention, the at least one processor of the apparatus, for example, of the safety controller may be configured to perform any of the method steps disclosed hereinabove.

In one embodiment of the invention, the safety controller may be configured to perform any of the method steps disclosed hereinabove.

The embodiments of the invention described herein may be used in any combination with each other. Several or at least two of the embodiments may be combined together to form a further embodiment of the invention. A method, an apparatus, a computer program or a computer program product to which the invention is related may comprise at least one of the embodiments of the invention described hereinbefore.

It is to be understood that any of the above embodiments or modifications can be applied singly or in combination to the respective aspects to which they refer, unless they are explicitly stated as excluding alternatives.

The benefits of the invention are related to improved elevator safety and improved elevator riding comfort.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE EMBODIMENTS

Reference will now be made in detail to the embodiments of the present invention, examples of which are illustrated in the accompanying drawings.

Figure 1:
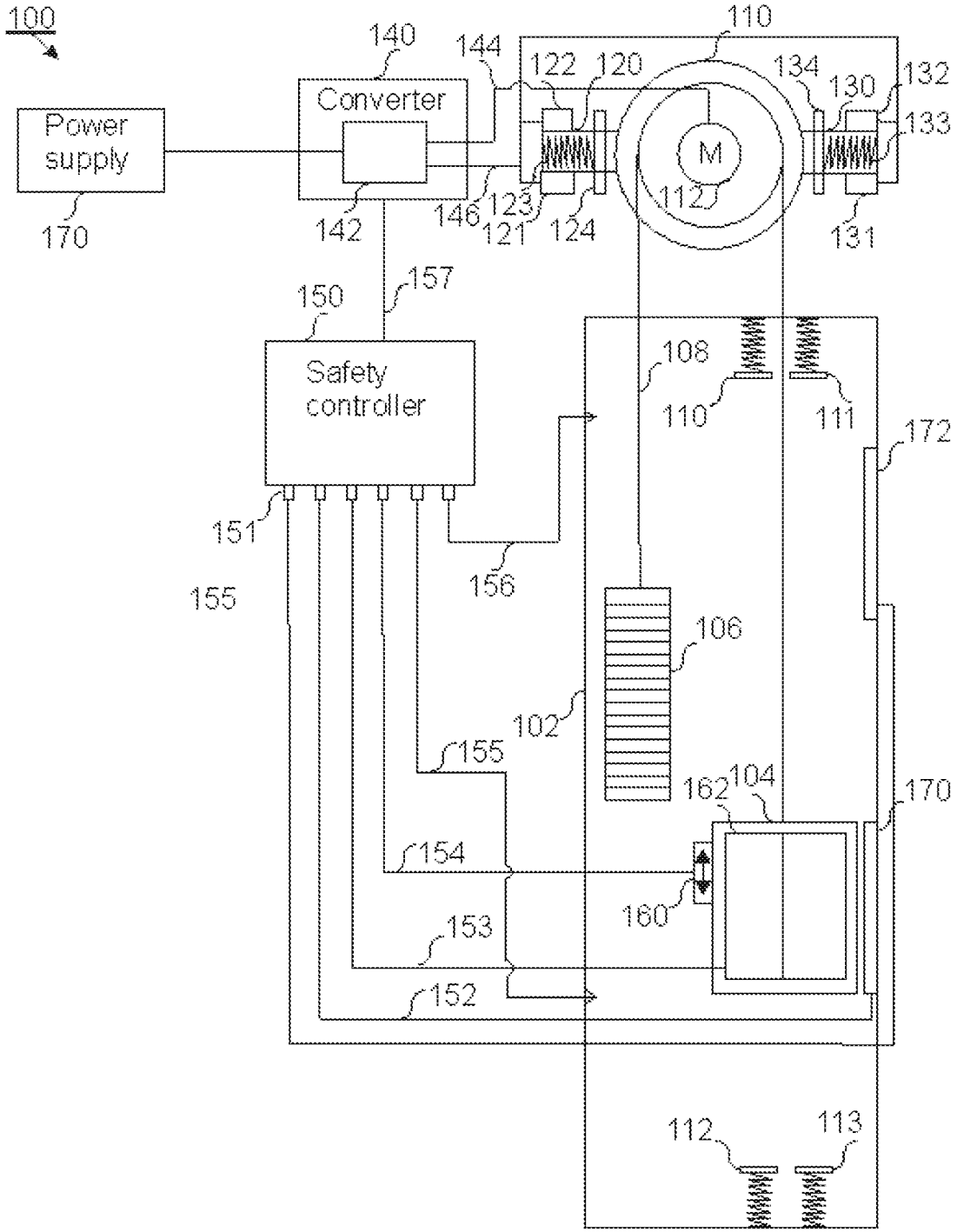
FIG. 1 illustrates an elevator comprising a safety controller and a converter connected to the safety controller in one embodiment of the invention.

FIG. 1 illustrates an elevator comprising a safety controller and a converter connected to the safety controller in one embodiment of the invention.

In FIG. 1 there is illustrated an elevator 100. The elevator is a traction elevator. Elevator 100 operates in an elevator shaft 102. Elevator 100 may be seen to comprise a plurality of apparatuses associated with elevator shaft 102. Elevator shaft 102 comprises at least one top buffer such as buffer 110 and buffer 111. Elevator shaft 102 comprises at least one bottom buffer such as buffer 112 and buffer 113. Associated with elevator shaft 102 there are also floor doors 170 and 172. Elevator 100 comprises an elevator car 104, which has elevator doors 162. Elevator 100 also comprises a counterbalance 106, which is connected to hoisting means 108 together with elevator car 104. Hoisting means 108 may be looped over a traction sheave 110. Traction sheave 110 may be driven, that is, rotated with an electrical motor 112. In order to apply brakes to traction sheave 110, there are two brakes shown on opposite sides of traction sheave 110. A brake 120 consists of a brake pad 124 which is pushed towards traction sheave 110 with a spring 123. The extending force of spring 123 is overcome by electrical magnet 121 and electrical magnet 122. Electrical magnets 121 and 122 attract brake pad 120 when supplied with electrical power. Similarly, a brake 130 consists of a brake pad 134 which is pushed towards traction sheave 110 with a spring 133. The extending force of spring 133 is overcome by electrical magnet 131 and electrical magnet 132. Electrical magnets 131 and 132 attract brake pad 134 when supplied with electrical power. The electrical power supplied to the electrical magnets in brake 120 and brake 130 keeps the both brakes open. If sufficient electrical power is not supplied to the electrical magnets in brake 120 and brakes 130, the springs 123 and 133 cause a braking of tracking wheel 110 by means of brake pad 124 and brake pad 134, respectively.

Electrical power is supplied to the electrical magnets in brake 120 and in brake 130 via power supply output 146 from electrical converter 140. Electrical power to motor 112 is supplied via power supply output 144 from electrical converter 140. Electrical converter 140 comprises a converter matrix 142, which is connected to power supply output 144 and power supply output 146. Converter matrix 142 is connected to a three-phase power supply 170, which may be a grid. Converter 140 is connected to a safety controller 150 via at least one control output such as a control output 157 illustrated in FIG. 1. A control output may be, for example, at least one message bus, a control voltage line, a control voltage terminal, or a safety relay output.

Safety controller 150 comprises at least one processor and a memory (not shown). Safety controller 150 may also comprise a back-up processor. Safety controller 150 comprises input interfaces 151-156, which may be connected safety contacts disposed in selected positions in elevator system, for example, shaft door safety contacts, end limit switches for car movement, buffer safety switch, overspeed governor safety switch etc. Input interfaces 151-156 may also be connected to an interface bridge, which may be communicatively connected via at least one internal bus to the at least one processor. Input interface 151 is communicatively connected to a sensor (not shown) associated with floor door 172. Input interface 152 is communicatively connected to a sensor (not shown) associated with floor door 170. Input interface 153 is communicatively connected to a sensor (not shown) associated with elevator car doors 162. Associated with elevator car 104 there is at least one speedometer 160 which measures the speed of elevator car 104. Speedometer 160 may also comprise an accelerometer (not shown). Safety controller 150 is configured to use motor 112 for braking traction sheave 110, for example, in the case of failure of both brakes 120 and 130.

Safety controller 150 is configured to determine a speed limit or an acceleration limit for elevator car 104 based on state information associated with elevator 100. The state information may comprise information on at least one of whether elevator car 104 is in a floor, whether elevator car 104 is being driven by motor 112 to a floor due to an elevator car, whether elevator car doors 162 are open or closed, whether floor door 170 is open or closed and whether floor door 172 is open or closed. Further state information may comprise whether elevator car 104 has overload, which is determined, for example, using scales (not shown) in elevator car 104. Further state information associated with elevator 104 may be received via sensor interfaces 151, 152, 153 and 154.

Depending on the state information, safety controller 150 determines the speed limit or the acceleration limit for elevator car 104. The speed limit or the acceleration limit may be zero, which means that the elevator car must be at standstill, if elevator car 104 is in a floor where elevator car doors 162 or floor doors such as floor doors 170 and 172 may be open. If elevator car 104 is being driven by motor 112 to a different floor, the speed limit or acceleration limit may be set a predefined margin value above a normal drive speed or normal acceleration. The normal drive speed may vary depending on how close elevator car 104 is to a floor. The predefined margin value may also vary depending on the normal drive speed.

In response to determining the speed limit or acceleration limit, safety controller 150 measures a first speed or first acceleration of elevator car 104, for example, using speedometer 160 or an accelerometer.

Safety controller 150 compares the first speed or the first acceleration to the speed limit or the acceleration limit, respectively, in order to determine whether the speed limit or the acceleration limit is exceeded.

In response to exceeding the speed limit or the acceleration limit, safety controller 150 applies brake 120 and brake 130 by disabling power supply to brakes 120 and 130. Safety controller may also disable power supply to motor 112.

In response to the applying of brake 120 and brake 130, safety controller 150 measures again speed or acceleration of elevator car 104 using at least speedometer 160 or an accelerometer. The measurement provides a second speed or a second acceleration of the elevator car.

Safety controller 150 determines using the second speed or the second acceleration whether elevator car 104 is slowing down.

In case elevator car 104 is not slowing down, safety controller 150 enables power supply to motor 112. Safety controller 150 may also control power supply to motor 112 via converter 140 so that motor 112 produces a torque which is sufficient to stop the movement of elevator car 104.

The embodiments of the invention described hereinbefore in association with the summary of the invention and FIG. 1 may be used in any combination with each other. At least two of the embodiments may be combined together to form a further embodiment of the invention.

Figure 2A:
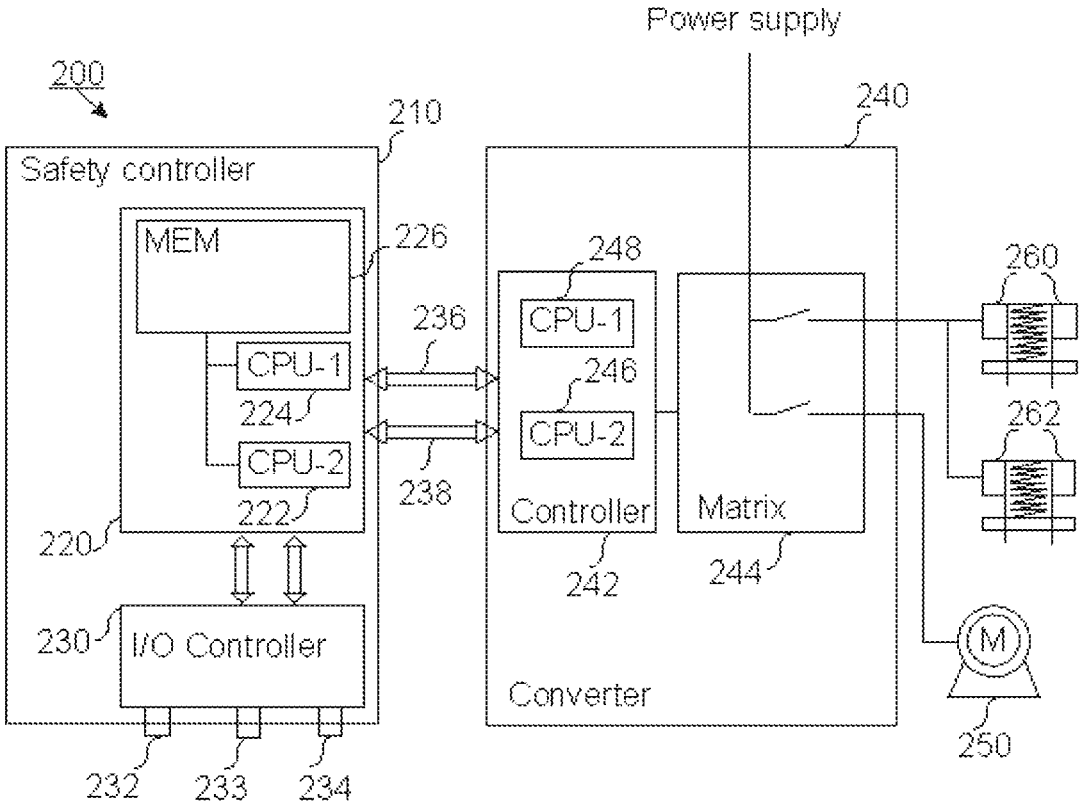
FIG. 2A illustrates a safety controller communicatively connected to a controller of a converter in one embodiment of the invention.

FIG. 2A illustrates a safety controller communicatively connected to a controller of a converter in one embodiment of the invention.

In FIG. 2A there is an elevator safety apparatus 200. Apparatus 200 comprises a safety controller 210. The safety controller may 210 comprise a memory 226, a first processor 224 and a second processor 222. Memory 226, first processor 224 and second processor 222 may be comprised in a chipset 220. First processor 224 and second processor 222 provide redundancy, for example, so that first processor 224 and second processor 222 monitor each other, for example, via common memory 226 or via a dedicated data channel or message bus. Memory 226, first processor 224 and second processor 222 may be communicatively connected to an input-output controller 230, for example, via chipset 220. Input-output controller comprises interfaces 232, 233 and 234. Interfaces 232, 233 and 234 may be connected to a number of electrical or electronic sensors associated with an elevator hoistway and an elevator car (not shown), for example, such as illustrated in FIG. 1. Safety controller 210 is connected to a converter 240 via a first message bus 236 and a second message bus 238. First message bus 236 and second message bus 238 provide redundancy and fault tolerance for the case of message bus failure. Converter 240 comprises a controller 242 and a matrix 244. Controller 242 comprises a first processor 248 and a second processor 246. First processor 224 and second processor 222 within safety controller 210 are configured to transmit a digital control signal having at least two separate fields, a first field indicating whether power may be supplied to brakes 260 and 262 and, a second field indicating whether power may be supplied to motor 250. Brakes 260 and 262 may correspond to brakes 120 and 130 in FIG. 1, respectively. Motor 250 may correspond to motor 112 in FIG. 1. The control signal is transmitted on first message bus 236 and on second message bus 238. The control signal is transmitted to controller 242. Based on the control signal controller 242 is configured to control connections in matrix 244. If the first field indicates that power may be supplied to brakes 260 and 262 matrix 244 connections supply power to a power supply output connected to brakes 260 and 262. If the second field indicates that power may be supplied to motor 250, matrix 244 connections supply power to a power supply output connected to motor 250.

Figure 2B:
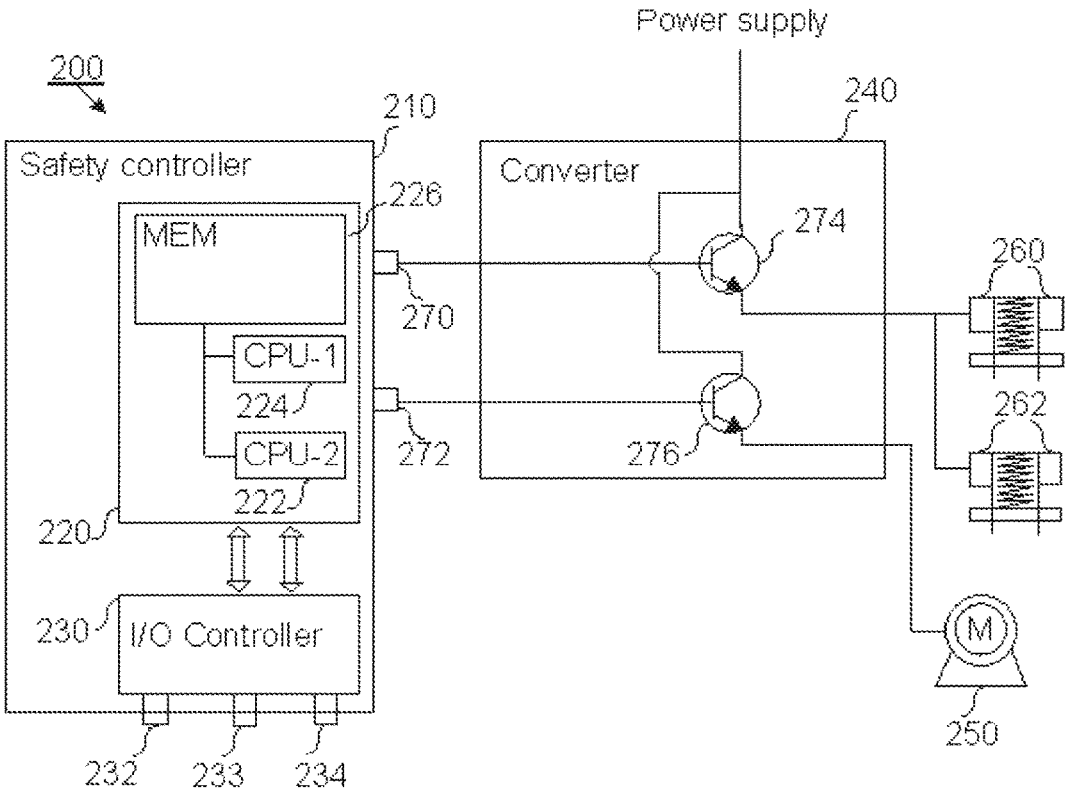
FIG. 2B illustrates a safety controller controlling electronically a converter in one embodiment of the invention.

FIG. 2B illustrates a safety controller controlling electronically a converter in one embodiment of the invention. In FIG. 2B first message bus 236 and second message bus 238 have been replaced with a first output terminal 270 and a second control terminal 272. First output terminal 270 is connected to a gate of at least one transistor 274, which controls power supply to brakes 260 and 262. Second output terminal 272 is connected to a gate of at least one transistor 276, which controls power supply to motor 250. A control voltage supplied by safety controller 210 via first output terminal 270 causes the at least one transistor 274 to become on and let power to be supplied to brakes 260 and 262. A control voltage supplied by safety controller 210 via second output terminal 272 causes the at least one transistor 276 to become on and let power to be supplied to motor 250.

Figure 2C:
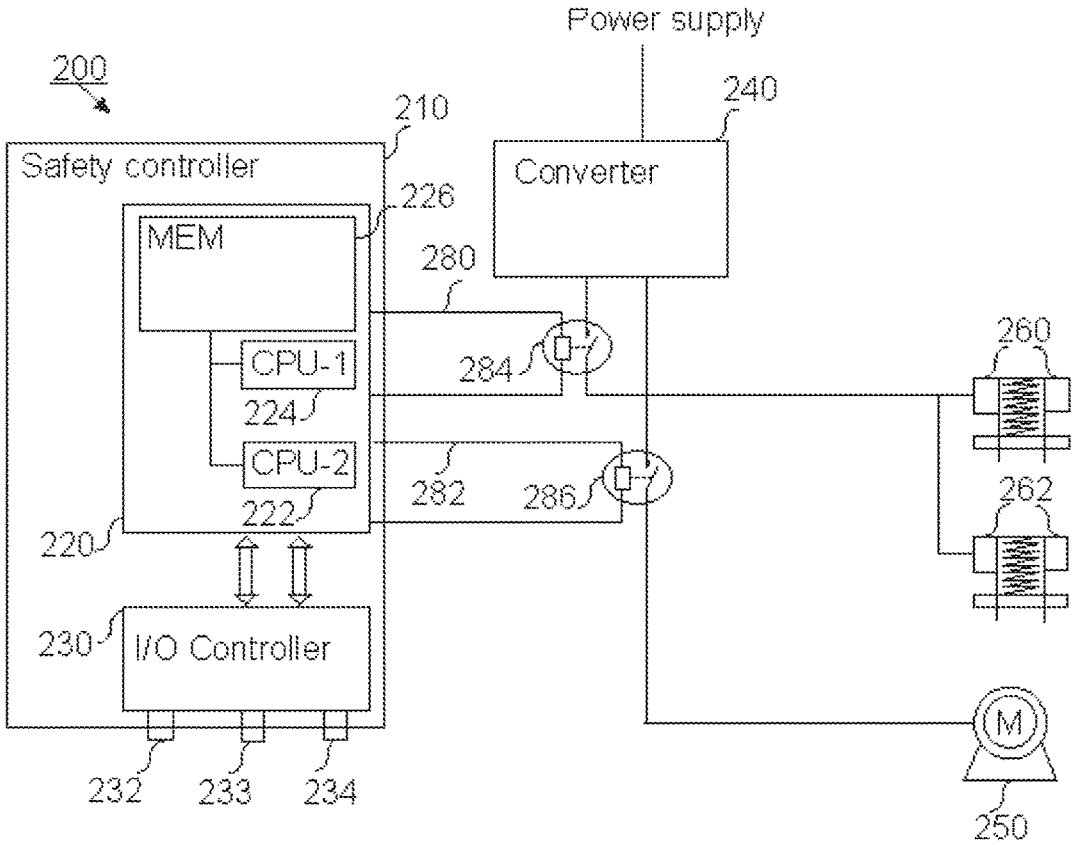
FIG. 2C illustrates a safety controller controlling electrically power supply to brakes and elevator motor in one embodiment of the invention.

FIG. 2C illustrates a safety controller controlling electrically a converter in one embodiment of the invention.

In FIG. 2C first message bus 236 and second message bus 238 have been replaced with a first contractor 284 and a second contactor terminal 286. A control voltage output by safety controller 210 via output terminal 280 to contactor 284 enables power supply to brakes 260 and 262, whereas a control voltage output by safety controller 210 via output terminal 282 to contactor 286 enables power supply to motor 250. Contactors 284 and 286 may be normally open type of contactors.

Figure 2D:
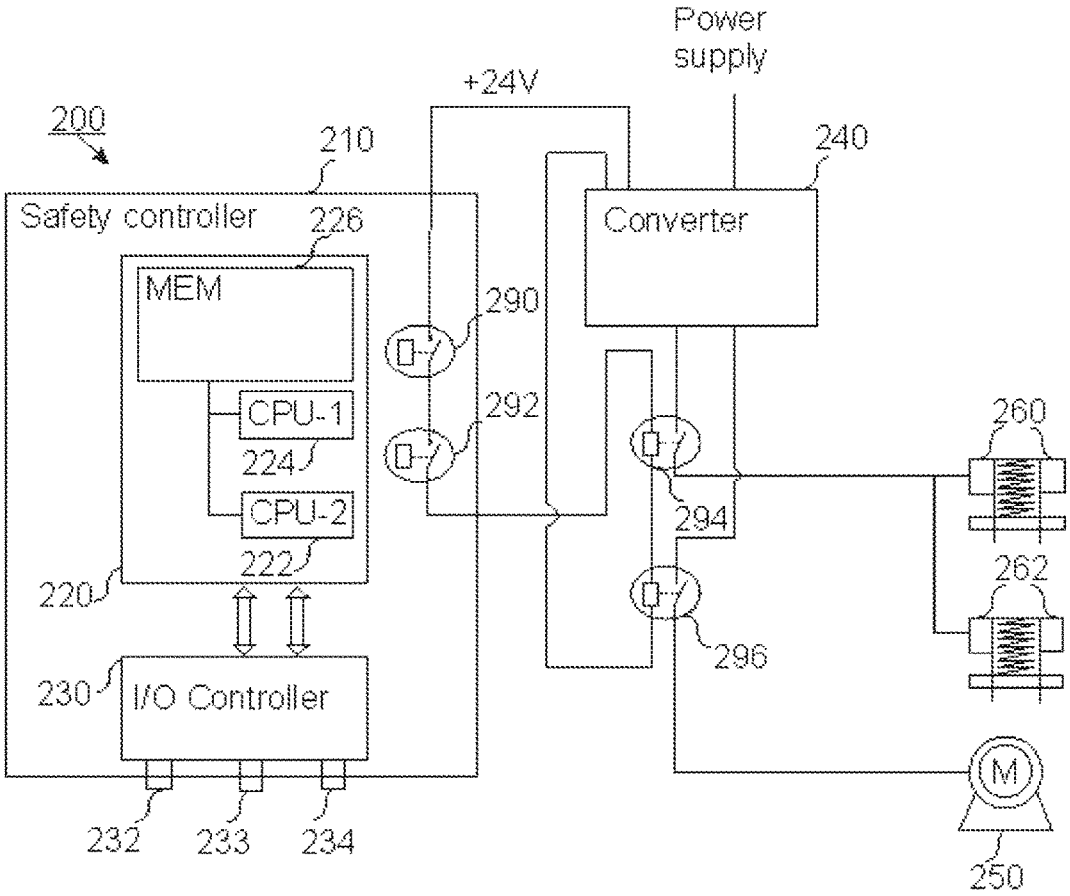
FIG. 2D illustrates a safety controller controlling electrically power supply to brakes and elevator motor using a single safety output in one embodiment of the invention.

FIG. 2D illustrates a safety controller controlling electrically power supply to brakes and elevator motor using a single safety output in one embodiment of the invention. In FIG. 2D safety controller 210 comprises a safety relay 290 and a safety relay 292 connected in series. Safety relays 290 and 292 are supplied a DC control voltage, for example, +24 V from electrical converter 240. The safety relays 290 and 292 are connected in series also with contactor 294 and contactor 296. Contactor 296 is connected to earth in electrical converter 240. Control voltage in contactor 294 enables power supply to brakes 260 and 262. Control voltage in contactor 296 enables power supply to motor 250. In case safety controller 210 decides to disable power supply to brakes 260 and 262 safety controller switches off safety relays 290 and 292, which leads to disabling power supply to motor 250 as well. In case power supply to motor 250 must be enabled by safety controller 210, it switches on safety relays 290 and 292 again.

The embodiments of the invention described hereinbefore in association with FIGS. 1, 2A, 2B, 2C and 2D may be used in any combination with each other. Several of the embodiments may be combined together to form a further embodiment of the invention.

Figure 3:
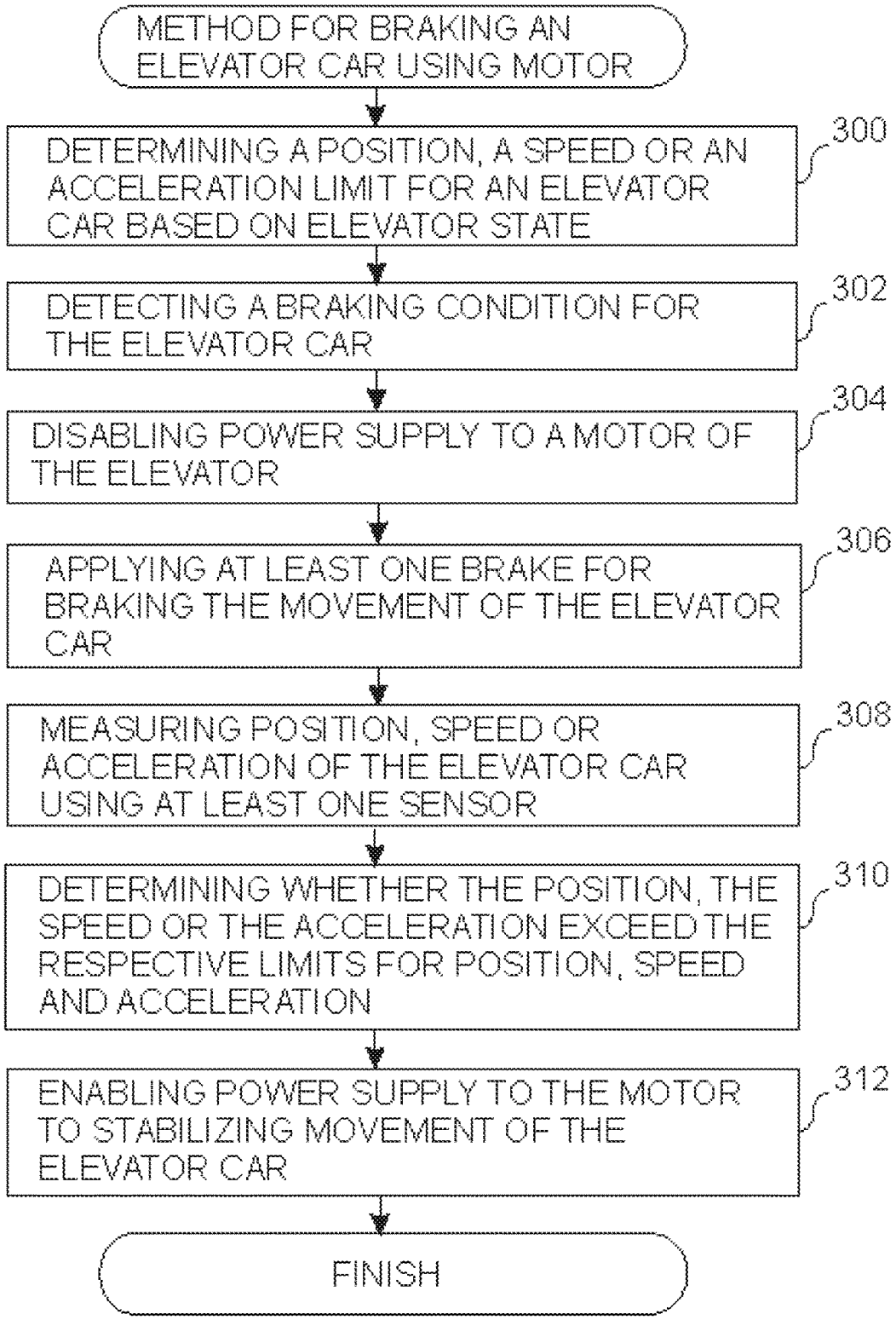
FIG. 3 is a flow chart illustrating a method for elevator braking in one embodiment of the invention.

FIG. 3 is a flow chart illustrating a method for elevator braking in one embodiment of the invention.

At step 300 there is determined at least one of a speed limit and an acceleration limit for an elevator car based on elevator state information. The elevator state information may comprise at least information on whether the elevator car is being driven or whether the elevator car is in a floor. The determination of the speed limit or the acceleration limit may be performed by a safety controller.

At step 302 a braking condition for the elevator car, that is, a need for performing braking of the elevator car is detected. The braking condition may be due to an exceeding of the speed limit or the acceleration limit by the elevator car. The braking condition may be due to arriving in a floor.

At step 304 power supply to the motor is disabled, in response to the detecting of the braking condition. The disabling may be performed by an elevator drive controller, that is, an elevator controller, if the elevator arrives to a floor or approaches a floor. The disabling may be performed by the safety controller, if at least one of the speed limit or the acceleration limit is exceeded, based on a measurement of the acceleration or the speed of the elevator car using an accelerometer or a speedometer, respectively.

At step 306 at least one brake for braking movement of the elevator car is applied, in response to the detecting of the braking condition. The brakes may be applied by disabling power supply to the brakes by the safety controller. The applying of the brakes may be performed by an elevator drive controller, if the elevator arrives to a floor or approaches a floor. The applying of the brakes may be performed by the safety controller, if at least one of the speed limit or the acceleration limit is exceeded, based on a measurement of the acceleration or the speed of the elevator car using an accelerometer or a speedometer, respectively.

At step 308 at least one of speed and acceleration of the elevator car is measured using at least one first sensor, in response to the applying of the at least one brake and the disabling of the power supply to the motor.

At step 310 there is determined whether the at least one of speed and acceleration of the elevator car exceeds the respective at least one of the speed limit and the acceleration limit. The determination may be performed by the safety controller.

At step 312 the safety controller enables power supply to the motor for stabilizing movement of the elevator car. The stabilizing may comprise stopping the movement of the elevator car or moving the elevator car to a floor.

In one embodiment of the invention, the speed limit or the acceleration limit may vary depending on whether the elevator car is in an acceleration phase to reach a normal maximum drive speed, whether the elevator car is in normal maximum drive speed or whether the elevator car is in a deceleration phase to arrive in floor.

In one embodiment of the invention, the elevator state information is received by the safety controller from a drive controller of the elevator. The drive controller may be responsible for controlling the speed of the elevator car based on elevator calls and elevator car position information.

Thereupon, the method is finished. The method steps may be performed in the order of the numbering of the steps.

The embodiments of the invention described hereinbefore in association with FIGS. 1, 2A, 2B, 2C, 2D and 3 or the summary of the invention may be used in any combination with each other. Several of the embodiments may be combined together to form a further embodiment of the invention.

The exemplary embodiments of the invention can be included within any suitable device, for example, including any suitable servers, workstations, PCs, laptop computers, PDAs, Internet appliances, handheld devices, cellular telephones, wireless devices, other devices, and the like, capable of performing the processes of the exemplary embodiments, and which can communicate via one or more interface mechanisms, including, for example, Internet access, telecommunications in any suitable form (for instance, voice, modem, and the like), wireless communications media, one or more wireless communications networks, cellular communications networks, 3G communications networks, 4G communications networks, LongTerm Evolution (LTE) networks, Public Switched Telephone Network (PSTNs), Packet Data Networks (PDNs), the Internet, intranets, a combination thereof, and the like.

It is to be understood that the exemplary embodiments are for exemplary purposes, as many variations of the specific hardware used to implement the exemplary embodiments are possible, as will be appreciated by those skilled in the hardware art(s). For example, the functionality of one or more of the components of the exemplary embodiments can be implemented via one or more hardware devices, or one or more software entities such as modules.

The exemplary embodiments can store information relating to various processes described herein. This information can be stored in one or more memories, such as a hard disk, optical disk, magneto-optical disk, RAM, and the like. One or more databases can store the information regarding cyclic prefixes used and the delay spreads measured. The databases can be organized using data structures (e.g., records, tables, arrays, fields, graphs, trees, lists, and the like) included in one or more memories or storage devices listed herein. The processes described with respect to the exemplary embodiments can include appropriate data structures for storing data collected and/or generated by the processes of the devices and subsystems of the exemplary embodiments in one or more databases.

All or a portion of the exemplary embodiments can be implemented by the preparation of one or more application-specific integrated circuits or by interconnecting an appropriate network of conventional component circuits, as will be appreciated by those skilled in the electrical art(s).

As stated above, the components of the exemplary embodiments can include computer readable medium or memories according to the teachings of the present inventions and for holding data structures, tables, records, and/or other data described herein. Computer readable medium can include any suitable medium that participates in providing instructions to a processor for execution. Such a medium can take many forms, including but not limited to, non-volatile media, volatile media, transmission media, and the like. Non-volatile media can include, for example, optical or magnetic disks, magneto-optical disks, and the like. Volatile media can include dynamic memories, and the like. Transmission media can include coaxial cables, copper wire, fiber optics, and the like. Transmission media also can take the form of acoustic, optical, electromagnetic waves, and the like, such as those generated during radio frequency (RF) communications, infrared (IR) data communications, and the like. Common forms of computerreadable media can include, for example, a floppy disk, a flexible disk, hard disk, magnetic tape, any other suitable magnetic medium, a CD-ROM, CDRW, DVD, any other suitable optical medium, punch cards, paper tape, optical mark sheets, any other suitable physical medium with patterns of holes or other optically recognizable indicia, a RAM, a PROM, an EPROM, a FLASH-EPROM, any other suitable memory chip or cartridge, a carrier wave or any other suitable medium from which a computer can read.

While the present inventions have been described in connection with a number of exemplary embodiments, and implementations, the present inventions are not so limited, but rather cover various modifications, and equivalent arrangements, which fall within the purview of prospective claims.

The embodiments of the invention described hereinbefore in association with the figures presented and the summary of the invention may be used in any combination with each other. Several of the embodiments may be combined together to form a further embodiment of the invention.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A method, comprising:

determining, by a safety controller, at least one of a speed limit and an acceleration limit for an elevator car based on elevator state information, the elevator state information comprising at least one of the elevator car is being driven, the elevator car is within a predefined distance from a destination floor, the elevator car is in a floor, and an attempt to apply at least one brake has been made;

detecting a need to perform braking of the elevator car, the need being due to at least one of the elevator car being within a predefined distance from a destination floor, an exceeding of the speed limit and an exceeding of the acceleration limit;

disabling power supply to the motor, in response to the detecting of the need to perform braking;

attempting to apply the at least one brake for braking movement of the elevator car, in response to the detecting of the need to perform braking;

measuring at least one of speed and acceleration of the elevator car using at least one first sensor, in response to the attempt to apply the at least one brake and the disabling of the power supply to the motor;

determining whether the at least one of speed and acceleration of the elevator car exceeds the respective at least one of the speed limit and the acceleration limit; and enabling, by the safety controller, power supply to the motor for stabilizing movement of the elevator car, in response to the exceeding of the respective at least one of the speed limit and the acceleration limit.

2. The method according to claim 1, the method further comprising:

repeating the determining, by the safety controller, of the at least one of the speed limit and the acceleration limit for the elevator car based on elevator state information, the elevator state information comprising at least one of the elevator car is being driven, the elevator car is within a predefined distance from a destination floor, the elevator car is in a floor, and an attempt to apply the at least one brake has been made, in response to the attempt to apply the at least one brake and the disabling of the power supply to the motor.

3. The method according to claim 1, the method further comprising:

measuring at the least one of an initial speed and an initial acceleration of the elevator car;

comparing, by the safety controller, the at least one of the initial speed and the initial acceleration of the elevator car to the respective at least one of the speed limit and the acceleration limit, to determine whether the at least one of the speed limit and the acceleration limit is exceeded.

4. The method according to claim 3, wherein the power supply to the motor is disabled by the safety controller, in response to the exceeding of the at least one of the speed limit and the acceleration limit, and the at least one brake is applied, by the safety controller, by disabling power supply to the at least one brake.

5. The method according to claim 1, the method further comprising:

determining, by the safety controller, a state of at least one second sensor associated with the elevator, the at least one second sensor indicating whether the elevator car may be moved without danger;

determining whether the elevator car or a counterweight of the elevator is heavier;

regulating power supply to the motor in order to bring the elevator car to the bottom floor, if the elevator car is heavier than the counterweight, or the top floor, if the counterweight is heavier that the elevator car, in response to the at least one second sensor indicating that the elevator car may be moved without danger.

6. The method according to claim 1, the method further comprising:

determining, by the safety controller, a state of at least one second sensor associated with the elevator, the at least one second sensor indicating whether the elevator car may be moved without danger; and regulating power supply to the motor in order to keep the elevator car in a stable vertical position, by the safety controller, in response to the at least one second sensor indicating that the elevator car may not be moved without danger.

7. The method according to claim 5, wherein the at least one second sensor comprises at least one door sensor indicating whether a door is closed.

8. The method according to claim 5, wherein the power supply to the motor is regulated by a frequency converter, under supervision of the safety controller.

9. The method according to claim 1, wherein the at least one brake of the elevator comprises at least two brakes configured to brake a traction wheel of the elevator.

10. The method according to claim 1, wherein the at least one brake of the elevator comprises at least two brakes configured to grip at least two respective tracks of the elevator car.

11. The method according to claim 1, wherein the at least one first sensor comprise at least one of an elevator car speedometer, an accelerometer, a traction sheave speedometer and an elevator car air pressure speedometer.

12. The method according to claim 1, wherein the safety controller is configured to control a converter via a control interface of the converter, the control interface being configured to receive a first separate power supply disable/enable signal for the at least one brake and a second power supply disable/enable for signals for the motor.

13. The method according to claim 1, wherein the elevator state information further comprises information on at least one of whether the speed of the elevator car being increased due to a departure from a floor, whether the elevator is being driven using maximum normal speed, whether the speed of the elevator car is being reduced due to a pending arrival to a floor.

14. The method according to claim 1, wherein the at least one brake is configured to keep in an open position while being supplied with electricity.

15. A safety apparatus for an elevator, the safety apparatus comprising:

a safety controller further comprising a first message bus, at least one sensor interface connected to the first message bus and at least one sensor in the elevator, and at least one processor connected to the first message bus, the at least one processor being configured to determine at least one of a speed limit and an acceleration limit for an elevator car based on elevator state information, the elevator state information comprising at least one of the elevator car is being driven, the elevator car being within a predefined distance from a destination floor, the elevator car being in a floor, and an attempt to apply at least one brake being made, to detect a need to perform braking of the elevator car, the need being due to at least one of the elevator car being within a predefined distance from a destination floor, an exceeding of the speed limit and an exceeding of the acceleration limit, to disable power supply to the motor, in response to the detecting of the need to perform braking, to attempt to apply the at least one brake for braking movement of the elevator car, in response to the detecting of the need to perform braking, to measure at least one of speed and acceleration of the elevator car using at least one first sensor, in response to the attempt to apply the at least one brake and the disabling of the power supply to the motor, to determine whether the at least one of speed and acceleration of the elevator car exceeds the respective at least one of the speed limit and the acceleration limit, and to enable power supply to the motor for stabilizing movement of the elevator car, in response to the exceeding of the respective at least one of the speed limit and the acceleration limit.

16. A computer program comprising code adapted to cause the following when executed on a data-processing system:

determining at least one of a speed limit and an acceleration limit for an elevator car based on elevator state information, the elevator state information comprising at least one of the elevator car is being driven, the elevator car is within a predefined distance from a destination floor, the elevator car is in a floor, and an attempt to apply at least one brake has been made;

detecting a need to perform braking of the elevator car, the need being due to at least one of the elevator car being within a predefined distance from a destination floor, an exceeding of the speed limit and an exceeding of the acceleration limit;

disabling power supply to the motor, in response to the detecting of the need to perform braking;

attempting to apply the at least one brake for braking movement of the elevator car, in response to the detecting of the need to perform braking;

measuring at least one of speed and acceleration of the elevator car using at least one first sensor, in response to the attempt to apply the at least one brake and the disabling of the power supply to the motor;

determining whether the at least one of speed and acceleration of the elevator car exceeds the respective at least one of the speed limit and the acceleration limit; and enabling power supply to the motor for stabilizing movement of the elevator car, in response to the exceeding of the respective at least one of the speed limit and the acceleration limit.

17. The computer program according to claim 16, wherein said computer program is stored on a non-transitory computer readable medium.

* * * * *